United States Patent [19]

Farquhar

[11] Patent Number: 4,799,468

[45] Date of Patent: Jan. 24, 1989

[54] THROTTLE CONTROL DEVICE

[75] Inventor: George N. Farquhar, Alingsås, Sweden

[73] Assignee: Aktiebolaget Electrolux, Sweden

[21] Appl. No.: 922,171

[22] Filed: Oct. 23, 1986

[30] Foreign Application Priority Data

Oct. 31, 1985 [SE] Sweden ..... 8505145

[51] Int. Cl.[4] ..... F02D 9/02

[52] U.S. Cl. ..... 123/400; 74/505; 74/89.18; 180/335

[58] Field of Search ..... 123/400, 403, 398, 198 DC; 74/89.17, 89.18, 89.19, 501 R, 504, 507, 505; 180/335; 440/60

[56] References Cited

U.S. PATENT DOCUMENTS

| | | | |
|---|---|---|---|
| 1,710,488 | 4/1929 | Oliphant | 180/335 X |
| 2,445,058 | 7/1948 | Fields | 180/335 |
| 4,144,770 | 3/1979 | Landën | 74/47 |
| 4,302,880 | 12/1981 | Elfving | 123/398 |
| 4,352,303 | 10/1982 | Christner | 74/505 X |
| 4,491,105 | 1/1985 | Johansson | 123/335 |
| 4,497,503 | 2/1985 | Irwin | 180/335 |
| 4,553,517 | 11/1985 | Andreasson | 123/335 |
| 4,681,198 | 7/1987 | Mas | 74/505 X |

*Primary Examiner*—Willis R. Wolfe, Jr.
*Assistant Examiner*—Eric R. Carlberg
*Attorney, Agent, or Firm*—Alfred E. Miller

[57] ABSTRACT

In a motor saw with an engine unit separated from a handle system by devibration elements, difficulties arise by in the use of a link system of iron plate or lever elements in performing a movement transfer without "backlash" etc. As a consequence thereof there is an involuntary speeding of the engine, great inherent moving play, propagation of vibrations between the carburetor and the finger grip, and sizing of elements adapted to every saw model. The invention eliminates these inconveniences by introducing a gear-driven, flexible shaft, e.g. a tightly wound helical spring which can transfer movements to the throttle by turning. The influence of relative movements between the engine and the handles can thus be eliminated.

8 Claims, 1 Drawing Sheet

THROTTLE CONTROL DEVICE

The present invention relates to a throttle control device of engines supported by vibration reducing elements in a frame, a machine body or the like.

Devices for turing a throttle in a carburetor usually comprise a Bowden-cable or a system of links by which control motions are transferred from a handle to the axis of the throttle. Since the engine is not firmly affixed to the frame, it can make relative movements to the frame, e.g. when loaded. Since the handle is not firmly affixed to the frame or a portion joined therewith, and the engine with its carburetor and throttle is displaced in the said relative movements from its position, a corresponding movement is transferred via said lever, links etc. to the throttle which then will change from its previous position. The operator must then readjust the throttle by means of the handle into a position the throttle had before the said relative movement, or into another position he will find proper. If the engine works with a varying load the necessity of readjusting the throttle soon returns, and the operator may then have difficulties in maintaining a r.p.m. suitable for every moment. It is therefore considered important to provide means for keeping the throttle in a predetermined position also during circumstances when the engine moves in relation to the supporting frame.

In accordance with the invention a device is provided with a gear and a spring transmission for a turning mvement to a throttle, in which device the influence of movements between the engine and the frame is eliminated. The turning movement of the throttle is therewith a uniform function of every change of position of the handle which the operator performs. The elimination of the influence of the relative movements on the throttle must be carried out in accordance with a given pattern of such movements. This is usually most special to every type of machine. In the following it will be described how such an elimination can be carried out on a type of machine with such a special pattern of relative movements between the engine and the frame.

The said device will be described in the following with reference to the accomanying drawing which shows in FIG. 1 a perspective view of the throttle control device of the invention and FIG. 2 the throttle control device assembled in a motor saw.

Figure 1:
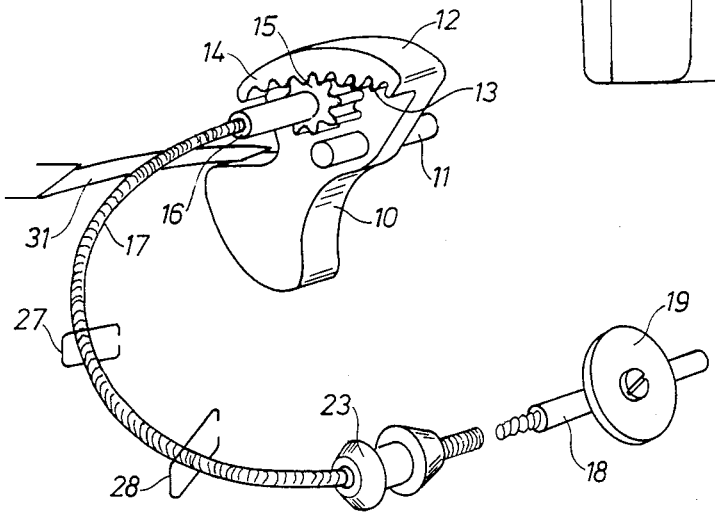

The throttle control device comprises the parts shown in FIG. 1 which shows a finger grip 10 with an axis 11 and a toothed segment 12 formed to have teeth 13 positioned inside a bow-like rim 4 on the segment. The finger grip 10 may be mounted in a earing in the handle of a saw. A gear is composed of this segment and a pinion 15 on a pin 16 connected to and integral with a flexible shaft 17 such as a helical spring wire or the like. The other end of the shaft is secured to a throttle axis 8 which supports a throttle 19 and is journalled in a carburetor housing so that the throttle can control the flow in the through channel 20 of the carburetor. The carburetor is located in a space with walls 21, one of which has a hole 22 penetrated by a sleeve 23 on the shaft 17.

Figure 2:
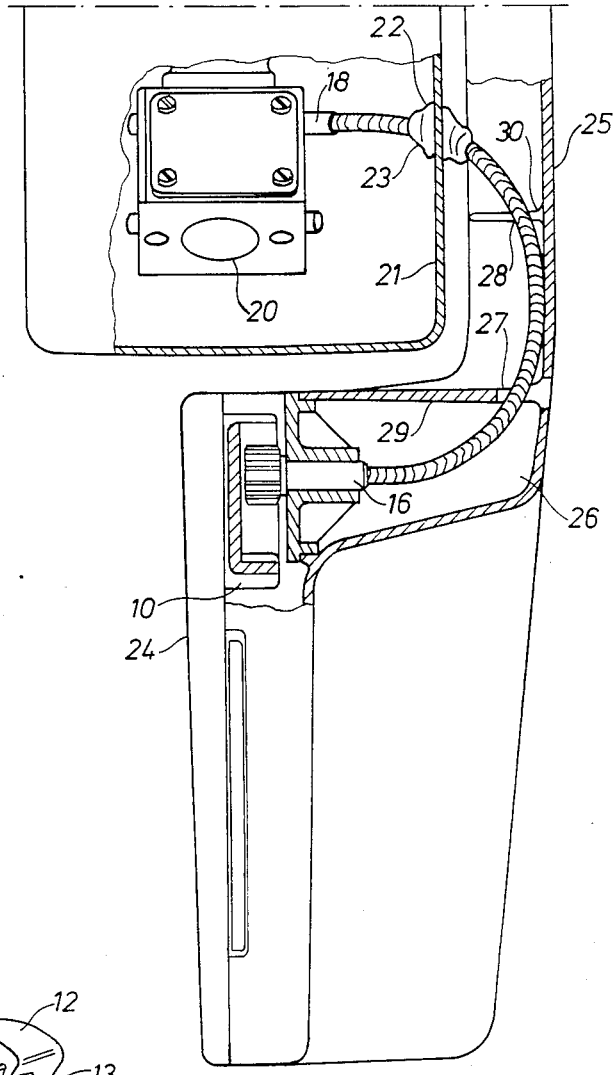

FIG. 2 shows the device assembled in the rear handle 24 of a motor saw. The type of saw here referred to has a front handle and the rear handle joined by means of a frame tube member 25 extended along the right side of the saw. The tube member has a bend 26 in its rear end and forms a space for the curved shaft 17 which is held in an even curve by passages 27,28 in intervening walls 29,30 in the tube member. The shaft is thus covered and protected against damage from the outside.

The mode of operation of the device is based on the principle that a small angular movement of the finger grip is geared up to a greater angular movement of the throttle axis. This gearing is effected in the gear when the segment 12 has a greater radius than the pinion 15. The throttle axis with the shown dimensions will rotate some 75° when th finger grip is rotated through some 25°. This offers a saving of room around the finger grip and facilitates the managing of the saw, since the angular movement to full gas is proportionally small and the shaft 17 has a certain pretension at both of the end positions of the throttle. For the return, a blade spring 31 in the handle can be used which is tensioned by the finger grip when it is turned to open the throttle. The spring resets the finger grip and the throttle into their initial positions when the grip is let free. Moreover, the gearing and the spring in the carburetter (not shown) can be so selected that the pretension in the axis eliminates the demand for a special return spring. The pretension will then act in such a way that the contact between the pinion 15 and the segmeng 12 will be totally free of play.

The embodiment described is an example how to keep the throttle in a predetermined position. However, it may be noted that similar solutions can be carried out and provided with other embodiments of the included members. For example, the segment can have the teeth positioned outwardly instead of the shown inwardly positioned ones. Such variations are intended to be included in the invention defined in the following claims.

I claim:

1. In a throttle control device for an i.c. engine supported by devibration elements in a member comprising a handle, said control device including a finger grip, a throttle on an axis and transferring means for transmitting movement between the finger grip and said throttle axis, the improvement wherein the finger grip is mounted to said member for pivotal movement, the transferring means includes a flexible shaft extending in a bow between the finger grip and the axis of said throttle, the finger grip being mounted to rotate the flexible shaft in response to pivoting movement thereof to transmit rotary movement to said throttle.

2. A throttle control device according to claim 1, wherein the end of the flexible shaft toward the finger grip is terminated by a pin having a pinion thereon and that the finger grip includes a toothed segment meshing with the pinion.

3. In a throttle control device for an i.c. engine supported by devibration elements in a member comprising a handle, said control device including a finger grip, a throttle on an axis and transferring means for transmitting movement between the finger grip and said throttle axis, the improvement wherein the transferring means includes a flexible shaft extending in a bow between the finger grip and the axis of said throttle, the end of the flexible shaft toward the finger grip being terminated by a pin having a pinion thereon, the finger grip including a toothed segment meshing with the pinion, the pinion having a radius less than the pitch radius of the toothed segment.

4. In a throttle control device for an i.c. engine supported by devibration elements in a member comprising a handle, said control device including a finger grip, a throttle on an axis and transferring means for transmitting movement between the finger grip and said throttle axis, the improvement wherein the transferring means includes a flexible shaft extending in a bow between the finger grip and the axis of said throttle, the finger grip with a bearing being inserted in the handle and forced in the direction to an initial end position by a pretension in the flexible shaft.

5. A throttle control device according to claim 4, wherein the flexible shaft is curved substantially 180° between the bearing of the finger grip and the axis of the throttle.

6. In a throttle control device for an i.c. engine supported by devibration elements in a member comprising a handle, said control device including a finger grip, a throttle on an axis and transferring means for transmitting movement between the finger grip and said throttle axis, the improvement wherein the transferring means includes a flexible shaft extending in a bow between the finger grip and the axis of said throttle, the end of the flexible shaft toward the finger grip being terminated by a pin having a pinion thereon, the finger grip including a toothed segment meshing with the pinion, the pin and the pinion being unitary with the flexible shaft.

7. A throttle control device according to claim 1 wherein said flexible shaft comprises a helical spring without an external sheath.

8. A throttle control device according to claim 1 wherein said flexible shaft comprises a wire without an external sheath.

* * * * *